United States Patent [19]

Vendramini

[11] Patent Number: 4,614,147

[45] Date of Patent: Sep. 30, 1986

[54] MACHINE FOR MANUFACTURING STRUCTURAL MEMBERS BY BRAIDING THREADS, AND STRUCTURAL MEMBERS OBTAINED THEREBY

[76] Inventor: Dante Vendramini, 34, rue du Général Leclerc, 92270 Bois Colombes, France

[21] Appl. No.: 713,667

[22] Filed: Mar. 19, 1985

[30] Foreign Application Priority Data

May 22, 1984 [FR] France ..... 84 04478

[51] Int. Cl.[4] ..... D04C 1/06; D04C 3/00; D04C 3/02

[52] U.S. Cl. ..... 87/5; 87/6; 87/7; 87/8; 87/11; 87/28; 87/30; 87/33; 87/34

[58] Field of Search ..... 57/6, 10, 11, 3; 87/5–8, 11, 28–30, 33, 34, 13

[56] References Cited

U.S. PATENT DOCUMENTS

| | | | |
|---|---|---|---|
| 2,132,566 | 10/1938 | Greene et al. | 57/10 |
| 2,139,011 | 12/1938 | Furness | 57/10 |
| 2,208,963 | 7/1940 | Diehl | 57/10 |
| 3,479,808 | 11/1969 | Frill | 57/10 |
| 3,486,409 | 12/1969 | Powell | 87/11 X |
| 3,507,137 | 4/1970 | Taleff et al. | 57/10 X |
| 3,870,580 | 3/1975 | Belcher | 156/181 |
| 3,955,467 | 5/1976 | Johnson, Jr. | 87/7 |
| 4,137,354 | 1/1979 | Mayes, Jr. et al. | 428/116 |
| 4,312,261 | 1/1982 | Florentine | 87/33 |
| 4,426,908 | 1/1984 | Ullmann | 87/11 X |

FOREIGN PATENT DOCUMENTS 1901630 1/1982 Fed. Rep. of Germany .

*Primary Examiner*—John Petrakes

*Attorney, Agent, or Firm*—Kane, Dalsimer, Kane, Sullivan and Kurucz

[57] ABSTRACT

Cores (a1–a4) pass through separate points in a plate (1) of the machine, over which plate thread-carrying spools ($17_1$–$17_{24}$) are free to move. Two pairs of spools (i.e. four spools) are associated with each of the six possible pairs of the cores (a1–a4). Both spools in each pair are wound in the same direction around the corresponding pair of cores. The other two spools corresponding to the same pair of cores wind round the pair in the opposite direction. At successive steps of the method, each spool in each pair of spools is swapped with the other spool of the pair to occupy the position previously occupied by the said other spool. As a result, each pair of cores is covered by two helical windings in each winding direction.

28 Claims, 42 Drawing Figures

2

1

4

3

5

7

6

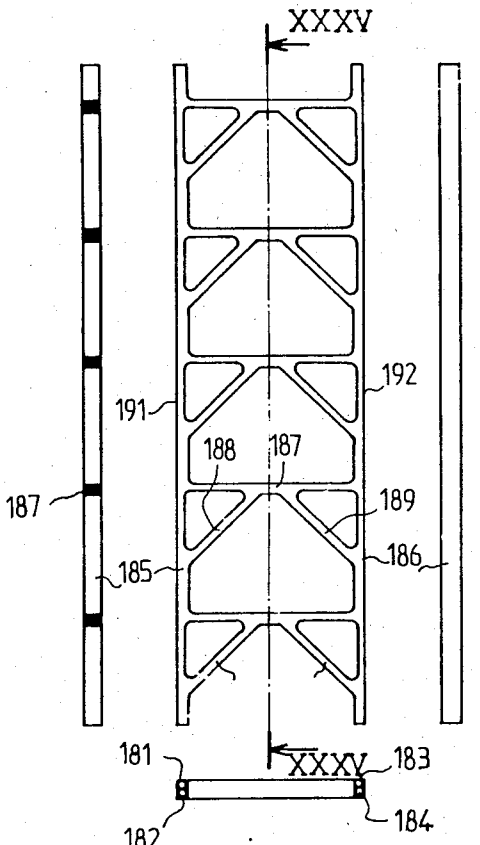
FIG. 34
FIG. 32
FIG. 35
FIG. 33
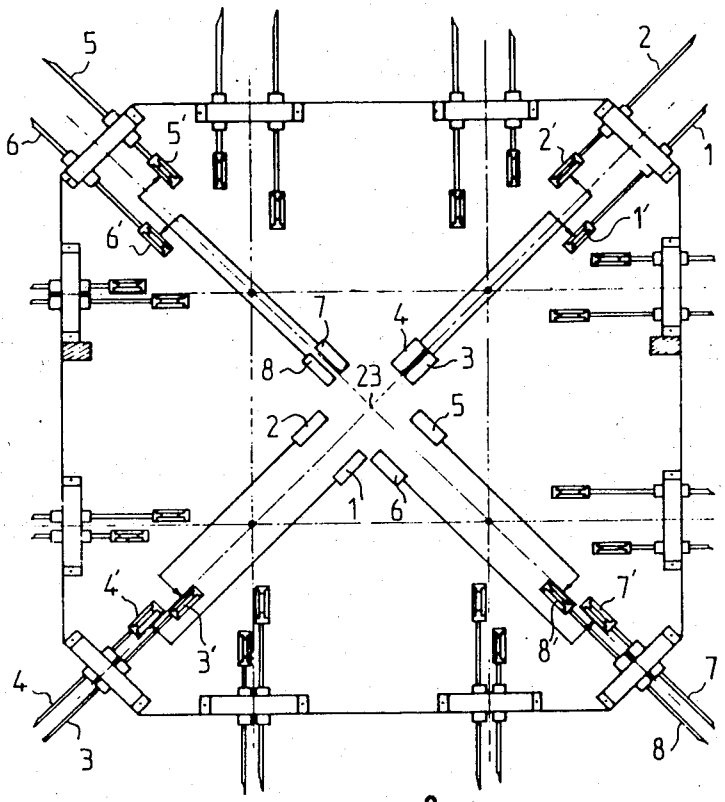
FIG. 10

FIG. 11
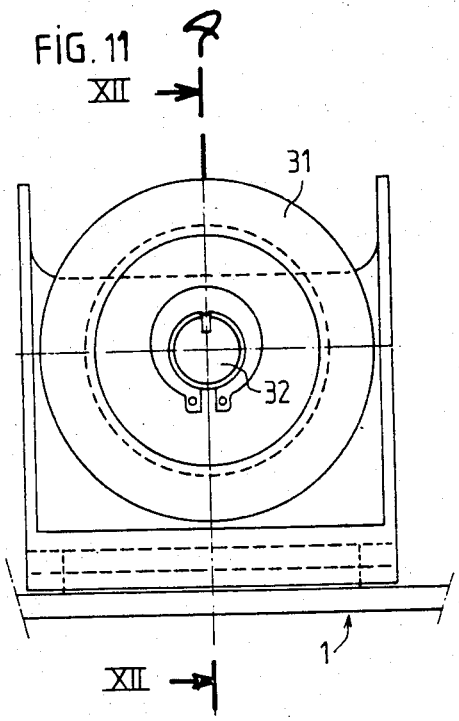
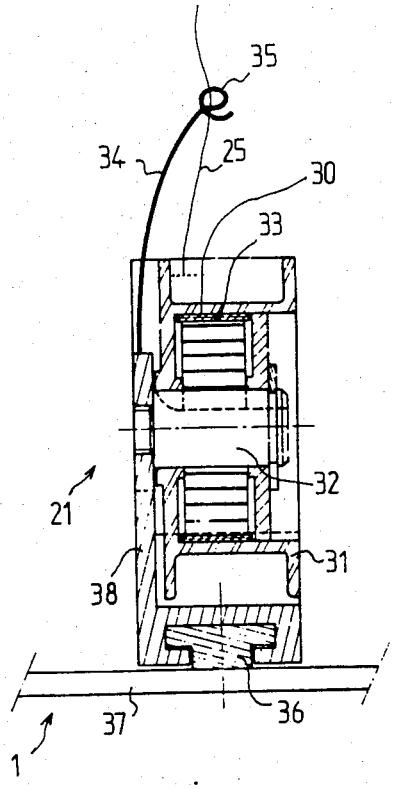
FIG. 12

XXXI
XXXII
XXIV
XXIII
176
175
174
173
172
167
164
168
166
162
169
171
161
167
165
163
175
176
114
142
145
141
144
113
131
114
136
133
112
134
117
115
116
137
111
118
132
129
138
135
113
157
155
157
140
147
149
115
153
143
152
153
148
151
146
156
154
156

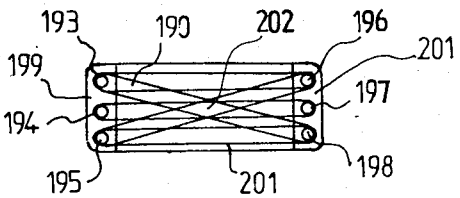
FIG. 36
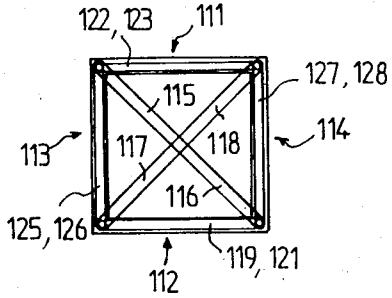
FIG. 27
FIG. 38
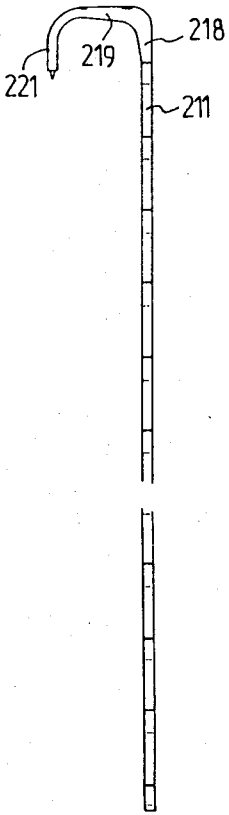
FIG. 37
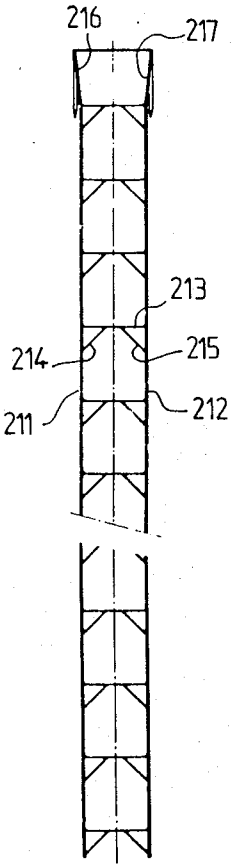

MACHINE FOR MANUFACTURING STRUCTURAL MEMBERS BY BRAIDING THREADS, AND STRUCTURAL MEMBERS OBTAINED THEREBY

The present invention relates to a machine for manufacturing structural members by braiding threads and also to structural members obtained by using the machine.

BACKGROUND OF THE INVENTION

Generally speaking, it is desirable for structural members to have maximum mechanical strength and minimum weight, and this is equally applicable to small and to large structures.

To this end, proposals have been made to make such members from threads of various materials which are assembled by being interwoven and which are often embedded in a hardened resin.

The object of the invention is to provide a machine capable of assembling thread-like elements in configurations that give rise to members having high mechanical strength and capable of taking full advantage of the intrinsic qualities of fibers which have recently become available such as carbon fibers, "KEVLAR" fibers, glass fibers, etc.

The object of the invention is more particularly to provide a machine capable of covering elongate elements or cores (which may be thread-like or strip-like and made of carbon or analogous fibers) with helically-wound threads, e.g. made of glass fibers, and with the dispositions of the cores and of the windings being chosen at will as a function of the desired structural characteristics, thereby providing industry with members better able than before to satisfy conditions of mechanical strength, of lightness, and of compactness as desired in many applications.

In machines for braiding or stranding, the threads are drawn from a plurality of spools which are rotatably mounted about their axes, and which up to now have been fixed in position relative to one another.

SUMMARY OF THE INVENTION

The invention is characterized by the fact that the spools or shuttles from which are drawn the threads intended to constitute the structural member core coverings, are displaceable in a plane transversal to the traction direction, with displacements being controlled to provide the desired thread configuration around the cores.

A machine in accordance with the invention includes at least one spool which is displaceable in a plane transversal to the traction direction of its thread, initially in parallel to a plane corresponding to a core or cores to be covered, as shown by two thread-like elements or by a strip-like element, and then transversely to the said plane and again parellel thereto, but in the opposite direction to the first movement, etc.

It is then possible to make a multiplicity of coverings for the core, either simultaneously or otherwise, which are parallel and/or transversal to one another, thereby providing a structural member having the desired mechanical characteristics.

The machine thus builds up a structural member in a succession of work periods, each of which comprises making the various covering over a predetermined length or pitch.

Such stepwise manufacturing favors automation of the various steps and thus favors minimal cost prices, and elements of uniform quality.

Coverings may be made in helical windings by combining a traction exerted on a thread with a movement of the spool from which the thread comes in a plane perpendicular to the traction direction.

However, in this respect the invention also provides for a first step during which the thread is taken from the spool without the spool moving bodily in a plane perpendicular to the traction, with movement taking place in this plane during a second step. To this end, the spool may be rotatably mounted about its axis by means of resilient return means.

The invention also provides for using the openings which occur naturally from the oblique disposition of the helically wound strands of thread to insert mandrels that take part in making the coverings and in stabilizing the configuration of the structural member.

Also in accordance with the invention, the mandrels are applied to facilitate the process of longitudinally driving the member during manufacture.

When the structural member is to include a resin, the resin may be put into place prior to and/or during the corecovering stage of structural member manufacture, and/or after said covering stage.

The invention provides structural members obtained by means of such a machine, regardless of whether the members are large like beams, or relatively small like the frames of tennis rackets.

BRIEF DESCRIPTION OF THE DRAWINGS

Embodiments of the invention are described by way of example with reference to the accompanying drawings, in which:

FIGS. 8 to 10 are views similar to FIGS. 3 to 6, but for other positions of the spool devices;

FIG. 11 is an elevation view of a spool and of the adjacent items to a larger scale;

FIG. 12 is a section on a line XII—XII in FIG. 11;

FIG. 27 is a similar view to FIG. 24, but showing a variant;

FIG. 32 is a front view of a frame member, for another embodiment;

FIG. 33 is a corresponding end view;

FIG. 34 is an elevation view of the same member, but at 90° to FIG. 32;

FIG. 35 is a section on a line XXXV—XXXV of FIG. 32;

FIG. 36 is a similar view to FIG. 33, but showing a variant;

FIG. 37 is a front view of another frame member in accordance with the invention;

FIG. 38 is a corresponding side view;

MORE DETAILED DESCRIPTION

Figures 1, 2:
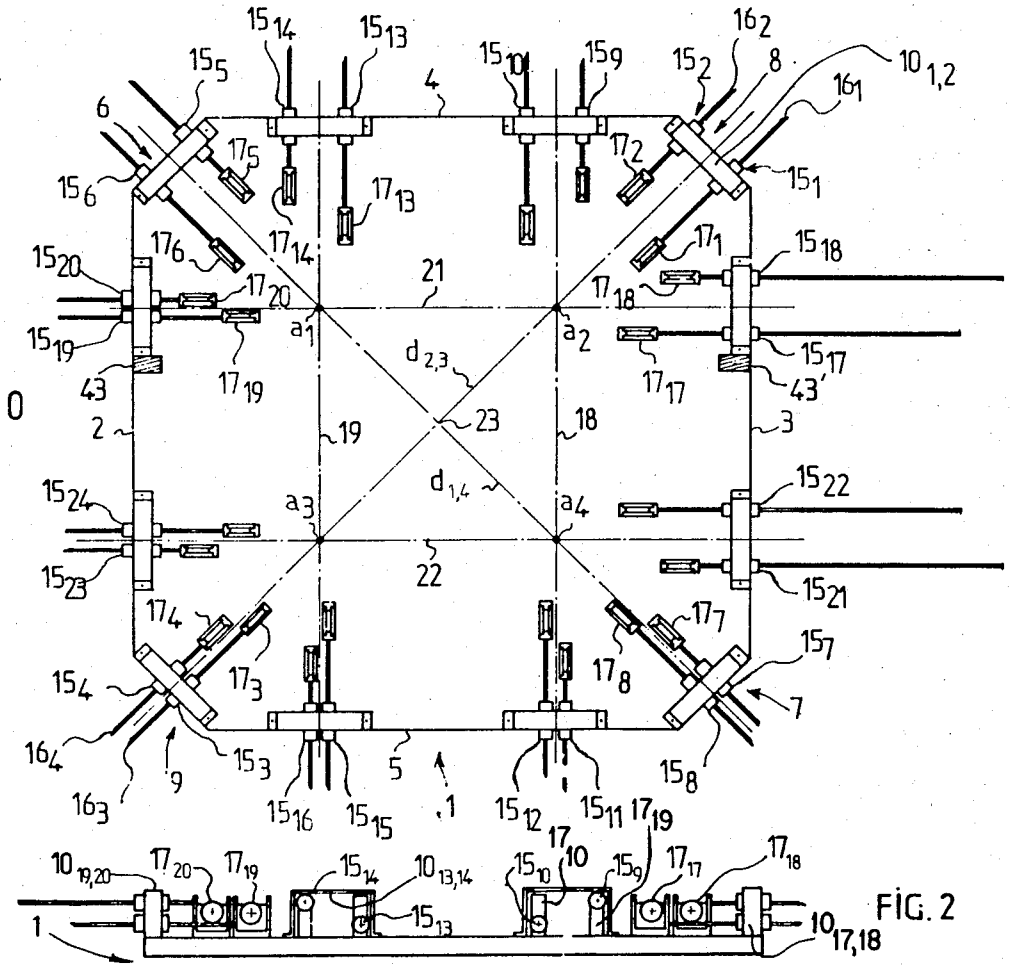
FIG. 1 is a diagrammatic plan view of the spool-carrying plate of the machine.
FIG. 2 is an elevation view of the rear of the plate, with some items omitted.

In the embodiment shown, the machine for braiding or for stranding comprises a platform or plate 1 (FIGS. 1 and 2) which is generally square in shape with its corners cut off, i.e. it is an irregular octagon having a first pair of parallel long sides 2 and 3, a second pair of parallel long sides 4 and 5 perpendicular to the first pair, and four cut-off corner flats 6, 7, 8, and 9.

This plate is symmetrically disposed about the structural member to be formed. Four points a1, a2, a3, and a4 at the vertices of a square mark the points where the extensions or projections of the cores of the future structural member intersect the plane of the plate 1.

A bracket $\mathbf{10}_{1,2}$ running along the corner flat 8 of the plate 1 supports two jacks $\mathbf{15}_1$, $\mathbf{15}_2$, having rods $\mathbf{16}_1$, $\mathbf{16}_2$ which are parallel to the diagonal $d_{2,3}$ passing through the points a2 and a3. Each jack rod 16 serves to displace a corresponding spool device $\mathbf{17}_1$ or $\mathbf{17}_2$ parallel to the said diagonal.

Likewise, the plate 1 supports jacks $\mathbf{15}_3$ and $\mathbf{15}_4$ along the cut-off corner flat 9 opposite to the flat 8 having rods $\mathbf{16}_3$ and $\mathbf{16}_4$ and suitable for displacing corresponding spool devices $\mathbf{17}_3$ and $\mathbf{17}_4$ parallel to the direction of the diagonal $d_{2,3}$.

The spool devices $\mathbf{17}_1$ and $\mathbf{17}_2$ are parallel to each other, and in the condition shown in FIG. 1, are further apart than the overall width of the spool devices $\mathbf{17}_3$ and $\mathbf{17}_4$.

Likewise, the flats 6 and 7 are equipped with respective pairs of jack devices $\mathbf{15}_5$, $\mathbf{15}_6$ and $\mathbf{15}_{17}$, $\mathbf{15}_8$ which are identical to the jack devices $\mathbf{15}_1$ to $\mathbf{15}_4$. Spool devices $\mathbf{17}_5$ and $\mathbf{17}_6$ are further apart from each other in a direction perpendicular to the diagonal $d_{1,4}$ than the overall width of spool devices $\mathbf{17}_7$ and $\mathbf{17}_8$.

The long side 4 of the plate is fitted with two pairs of jack devices $\mathbf{15}_9$, $\mathbf{15}_{10}$ and $\mathbf{15}_{13}$, $\mathbf{15}_{14}$. The opposite side 5 of the plate 1 is fitted with two pairs of jack devices $\mathbf{15}_{11}$, $\mathbf{15}_{12}$ and $\mathbf{15}_{15}$, $\mathbf{15}_{16}$. The long side 3 of the plate is fitted with two pairs of jack devices $\mathbf{15}_{17}$, $\mathbf{15}_{18}$ and $\mathbf{15}_{21}$, $\mathbf{15}_{22}$. The opposite side 2 of the plate 1 is fitted with two pairs of jack devices $\mathbf{15}_{19}$, $\mathbf{15}_{20}$ and $\mathbf{15}_{23}$, $\mathbf{15}_{24}$. The spacings of opposite pairs of these long side jacks are different in the same manner as already described with respect to the diagonally opposite pairs of jacks $\mathbf{17}_1$, $\mathbf{17}_2$ and $\mathbf{17}_3$ and $\mathbf{17}_4$. The plane of symmetry 18 common to the jacks $\mathbf{15}_9$, $\mathbf{15}_{10}$ and $\mathbf{15}_{11}$, $\mathbf{15}_{12}$ passes through the points a2 and a4. The plane of symmetry 19 common to the jacks $\mathbf{15}_{13}$, $\mathbf{15}_{14}$ and $\mathbf{15}_{15}$, $\mathbf{15}_{16}$ passes through the points a1 and a3. The plane of symmetry 21 common to the jacks $\mathbf{15}_{17}$, $\mathbf{15}_{18}$ and $\mathbf{15}_{19}$, $\mathbf{15}_{20}$ passes through the points a1 and a2. The plane of symmetry 22 common to the jacks $\mathbf{15}_{21}$, $\mathbf{15}_{22}$ and $\mathbf{15}_{23}$, $\mathbf{15}_{24}$ passes through the points a3 and a4.

In the condition of the plate 1 shown in FIG. 2, the axes of the jack rods in any pair are at different heights above the plate: for example, the axis of the jack $\mathbf{15}_{14}$ is further from the top surface 20 of the plate 1 than is the axis of the jack $\mathbf{15}_{13}$.

Figure 3:
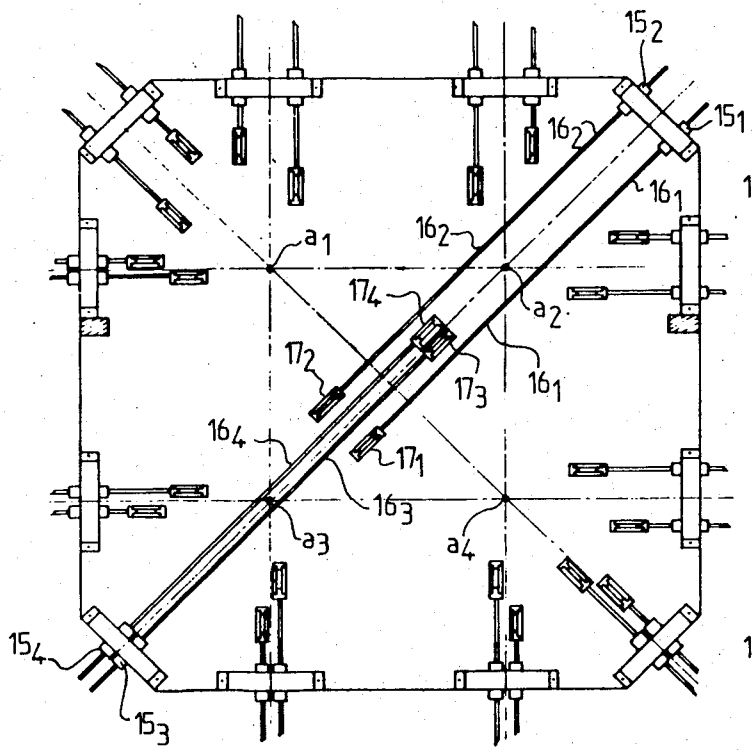

Starting from an initial condition as shown in FIG. 1 at a "Time 0", a first step of machine operation concerns displacing the spool devices which are moved by simultaneously actuating the jacks $\mathbf{15}_1$, $\mathbf{15}_2$ and $\mathbf{15}_3$, $\mathbf{15}_4$ to bring the spool devices $\mathbf{17}_1$, $\mathbf{17}_2$ and $\mathbf{17}_3$, $\mathbf{17}_4$ to the positions shown in FIG. 3 at the end of the first step, i.e. at "Time 1". These four spool devices are moved towards each other and cross the intervening diagonal a1–a4 in opposite directions.

Figure 4:
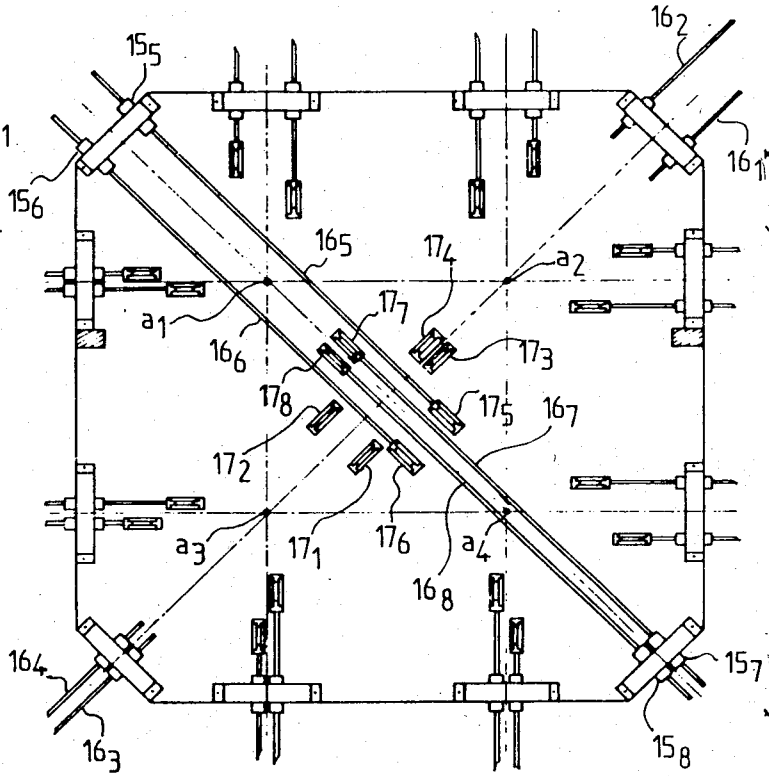
FIGS. 3 to 6 are views analogous to FIG. 1 with the spool devices in various other conditions.

During the next step, after the jack rods $\mathbf{16}_1$, $\mathbf{16}_2$, $\mathbf{16}_4$, and $\mathbf{16}_4$ have been retracted, the jack devices $\mathbf{15}_5$, $\mathbf{15}_6$ and $\mathbf{15}_7$, $\mathbf{15}_8$ are actuated to put the corresponding spools 17 in the positions shown in FIG. 4 at "Time 2". These movements are parallel and in opposite directions, causing the spools 17 to cross the intervening diagonal a2–a3 which has been left free by retracting the jack rods $\mathbf{16}_1$–$\mathbf{16}_4$. In the position shown in FIG. 4, the spools $\mathbf{17}_7$ and $\mathbf{17}_8$ are located in between the jack rods $\mathbf{16}_5$ and $\mathbf{16}_6$. These spools $\mathbf{17}_7$ and $\mathbf{17}_8$ are in the same relative disposition as the spools $\mathbf{17}_3$ and $\mathbf{17}_4$, but offset therefrom by a counterclockwise rotation through 90°. The positions of the spools $\mathbf{17}_5$ and $\mathbf{17}_6$ are likewise similarly positioned to the spools $\mathbf{17}_1$ and $\mathbf{17}_2$, but are offset therefrom by a counterclockwise rotation through 90°. The jack rods $\mathbf{16}_5$–$\mathbf{16}_8$ are then retracted.

Figure 5:
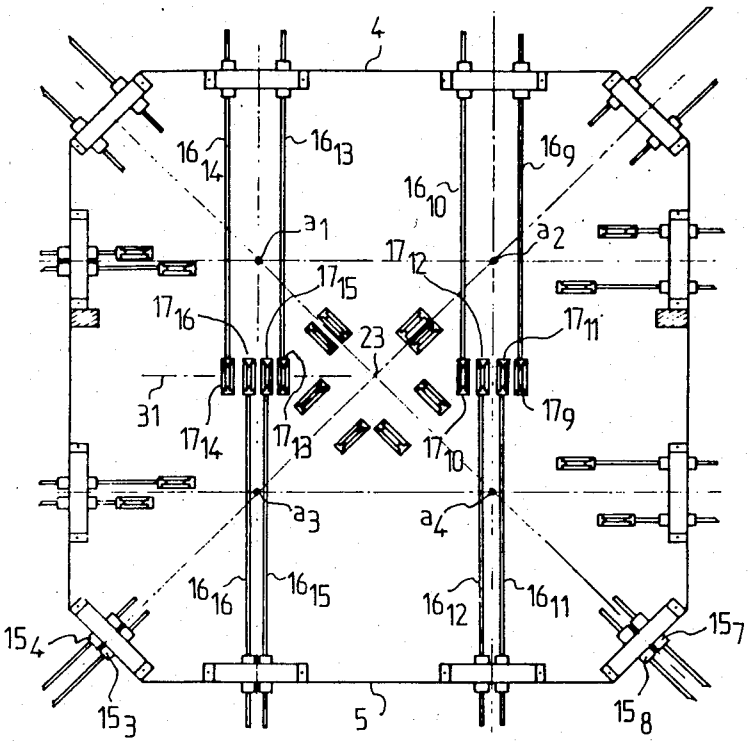

The final position of the following step is shown as "Time 3" in FIG. 5. Eight jack rods are operated during this step simultaneously: i.e. rods $\mathbf{16}_9$, $\mathbf{16}_{10}$, $\mathbf{16}_{11}$, $\mathbf{16}_{12}$, $\mathbf{16}_{13}$, $\mathbf{16}_{14}$ and $\mathbf{16}_{15}$, $\mathbf{16}_{16}$. The axes of the corresponding spools are then in a common plane 31 passing through the center 23 of the plate 1 and parallel to its long sides 4 and 5. The jack rods $\mathbf{16}_9$–$\mathbf{16}_{16}$ are then retracted to their initial positions.

Figure 6:
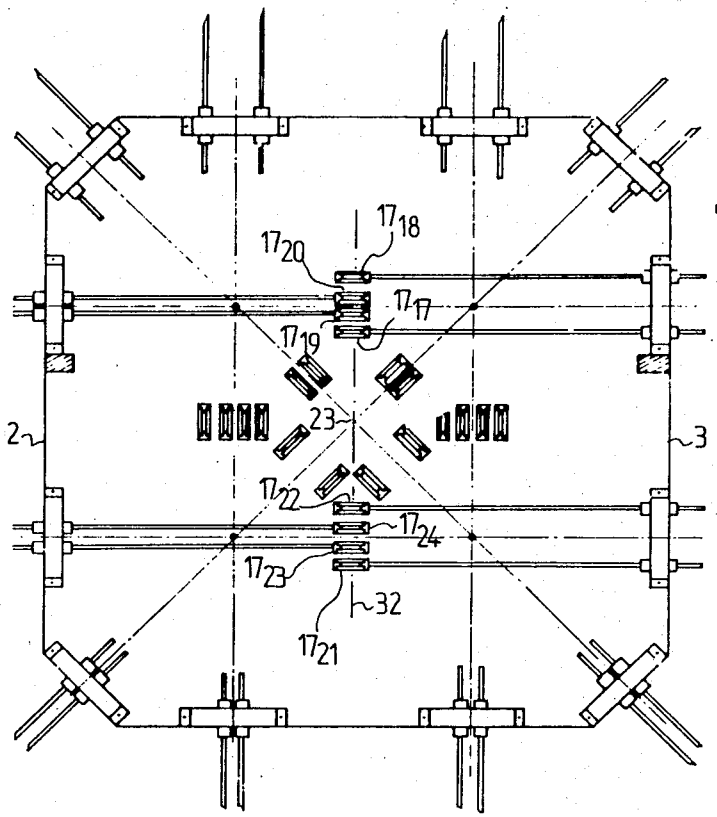

The final position of the next step is shown as "Time 4" in FIG. 6. In this case, the spools 17 having index numbers 17 to 24 are put into their respective central positions with their axes lying on a common plane 32 passing through the center 23 of the plate 1 and parallel to its long sides 2 and 3. At the end of this step, as at the end of the preceding steps, the corresponding jack rods 16 having index numbers 17 to 24 are retracted to their intitial positions.

Figure 7:
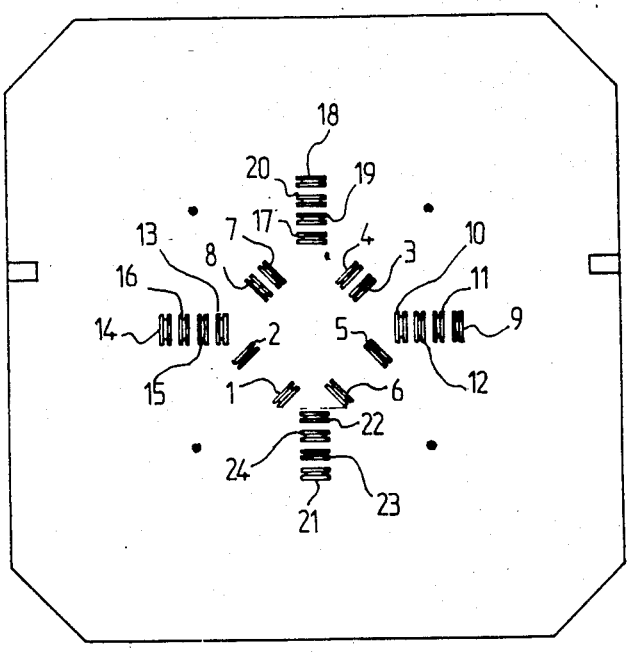
FIG. 7 is a view of the plate with all the spools shown being in their central positions, and with some items being omitted.

The resulting position is shown in FIG. 7 as "Time 5", in which all the spools are in their central positions and none of the jack rods lies over the portion of the plate 1 intended for spool device displacement.

This position corresponds to the end of the first half period of machine operation.

The following step is the first spool device return step. During this step, the jack rod $16_{12}$ is moved in its bracket $16_{11,12}$ to come opposite to the spool device $17_9$, and is then extended to come into contact with the spool device $17_9$ and to hook on to it. The jack rod is then returned into the jack $15_{12}$ and is again moved sideways in its bracket $16_{11,12}$ to return to its initial position. This has the effect of causing the spool $17_9$ to follow the path marked by an arrow in FIG. 8, which path is generally L-shaped, having an initial longitudinal arm followed a transverse arm that brings the spool device $17_9$ into a position marked 12' which was the initial position of the spool $17_{12}$. Likewise and simultaneously the spool device $17_{10}$ is brought to the starting point 11' by an L-shaped movement as shown by arrow 10–11'. These two motions can take place simultaneously by the jacks $15_{11}$ and $15_{12}$ being at different heights. The spools 9 and 10 are thus moved to the positions which were initially occupied by the spools 11 and 12. Likewise, the spools 11 and 12 are moved by the jack rods $16_9$ and $16_{10}$ respectively from their central positions to positions 10' and 9' which were initially occupied by the spools 10 and 9.

During the same step, the spool 13 is moved from its central position to the position 16' which was initially occupied by the spool 16 and the spool 14 is moved from its central position to the position 15' which was initially occupied by the spool 15. Likewise, the spool 15 is moved to 14' which was initially occupied by the spool 14 and the spool 16 is moved to the position 13' which was initially occupied by the spool 13.

Figure 8:
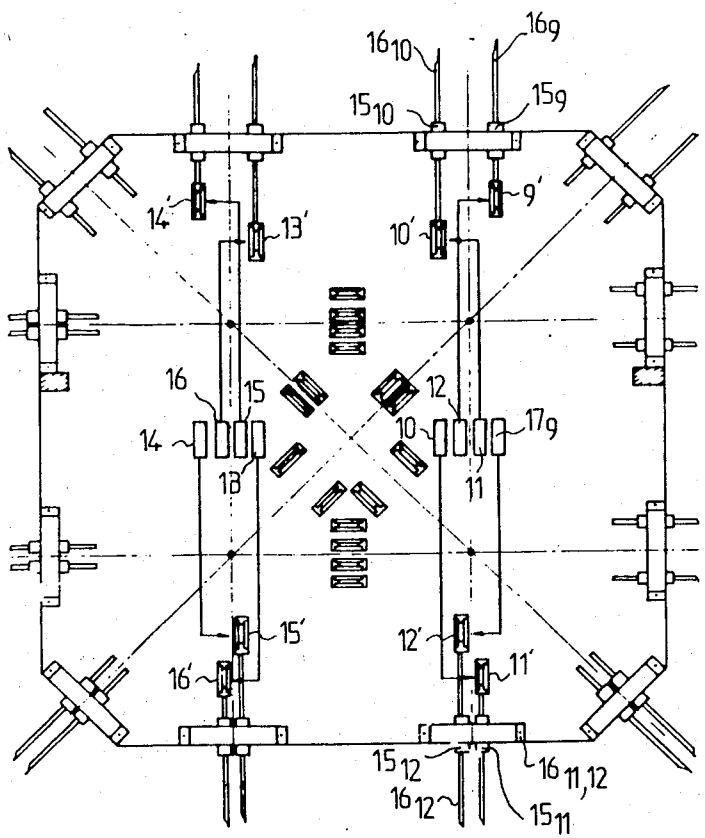

At the end of this step, the spools are in the position shown in FIG. 8 as "Time 6".

Figure 9:
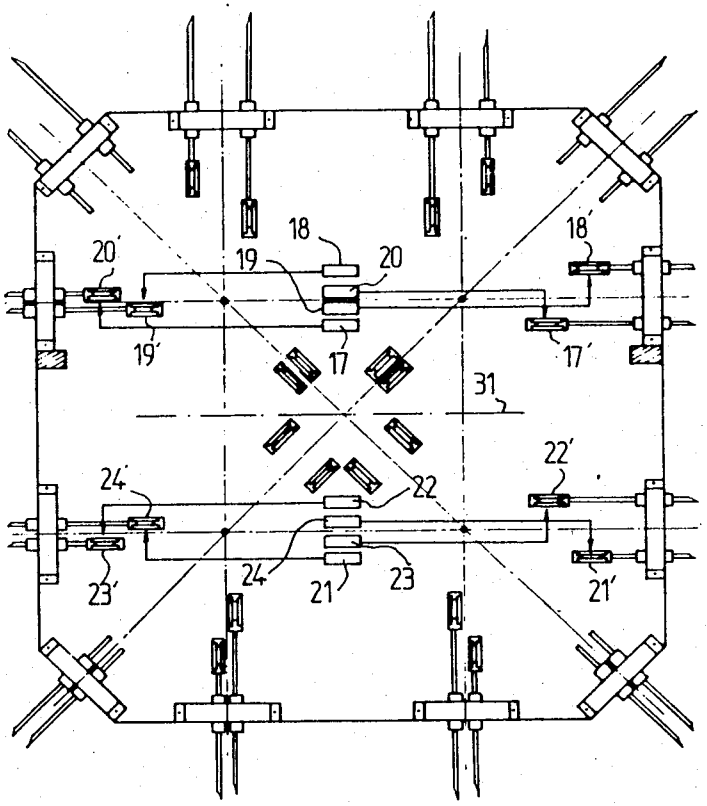

FIG. 9 relates to the next step. This step is substantially the same as the previous step, except that it is the spools 17 to 24 which are swapped in pairs by moving along paths which are perpendicular to those used to swap the spools 9 to 16 in pairs. In other words the spool 18 is moved to the initial position 19' of the spool 19, the spool 17 is moved to the initial position 20' of the spool 20, the spool 20 is moved to the initial position 17' of the spool 17 and the spool 19 is moved to the initial position 18' of the spool 18.

At the same time the spool 22 is moved to the initial position 23' of the spool 23, the spool 21 is moved to the initial position 24' of the spool 24, the spool 24 is moved to the initial position 21' of the spool 21 and the spool 23 is moved to the initial position 22' of the spool 22.

At the end of this step, the spools are in the positions shown in FIG. 9 as "Time 7".

During the next step as shown in FIG. 10, the diagonally moved spools are swapped in pairs along the a2–a3 diagonal as follows:

spool 1 is moved to the initial position 4' of spool 4;
spool 2 is moved to the initial position 3' of spool 3;
spool 3 is moved to the initial position 2' of spool 2; and
spool 4 is moved to the initial position 1' of spool 1.

Similarly, and at the same time since since there is no need to extend the jack rods more than half way across the plate 1, spools are swapped in pairs along the a1–a4 diagonal as follows:

spool 5 is moved to the initial position 8' of spool 8;
spool 6 is moved to the initial position 7' of spool 7;
spool 7 is moved to the initial position 6' of spool 6; and
spool 8 is moved to the initial position 5' of spool 5.

At the end of this step, the spools are in the positions shown in FIG. 10 as "Time 8". However, this position is the same as the initial position, except that the spools have been swapped in substantially symmetrical pairs about the center 23 of the plate or about the planes 31 or 32 as the case may be.

Each spool device 21 (see FIGS. 11 and 12) comprises a spool body 31 which is rotatable about a shaft 32 mounted on a body 38. A flat spring 30 rubs against the rim 33 of the spool 31, and also provides resilient return means therefor. A metal wire 34 having a loop 35 serves to guide the thread 25 as it leaves the spool 31. In the central position of each spool device 21, when released from the jack rods, the body 38 holds the spool fixed to the plate 1 by receiving a length of tongue 36 fixed to the upper surface 37 of the plate 1.

In another embodiment of the machine, the spool devices are moved manually. The spool devices are then guided by grooves or rails such as 101 and 102 shown in FIG. 39, which grooves or rails are provided in or on a plate 103 lying over the plate 1 and connected thereto by spacers 104.

Figure 40:
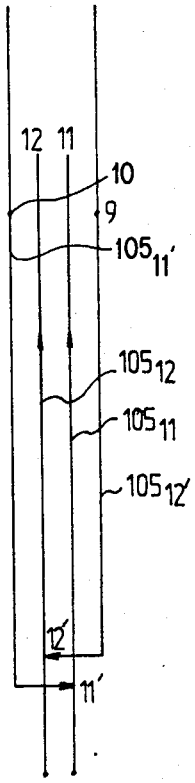
FIG. 40 is a diagrammatic view of the path of a spool device.

FIG. 40 is a diagram showing the path $105_{11}$ of the spool 11 during the first half period and the path $105_{12}$ of the spool 12 during the first half period. These two paths are rectilinear.

During the second half period the spools 9 and 10 are moved respectively to the initial positions 12' and 11' of the spools 12 and 11 via paths $105_{12'}$ and $105_{12'}$. In this embodiment, these paths are L-shaped.

Figure 41:
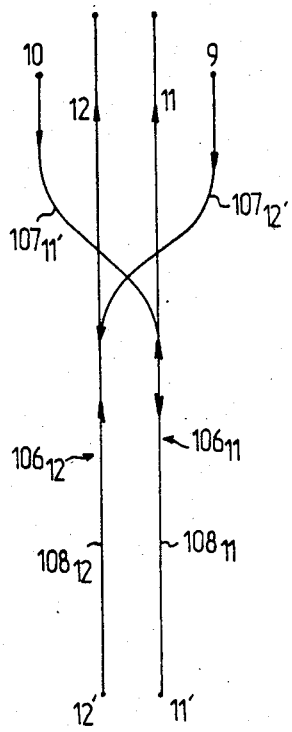
FIG. 41 is a similar view to FIG. 40, but showing a variant in which the spool devices are displaced manually.

FIG. 41 shows a variant in which the path $106_{11}$ is identical to the path $105_{11}$, but in which during the second half period the spool device 10 is moved to the outer end $108_{11}$ of the path $106_{11}$ to the position 11' by following a curved path $107_{11'}$. Similarly, the spool 9 is moved to the end $108_{12}$ of the path $106_{12}$ to the position 12' via a curved path $107_{12'}$.

Figure 39:
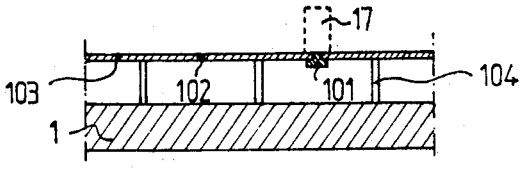
FIG. 39 is a diagrammatic section through an embodiment of the machine in which the spool devices are manually driven.
Figure 42:
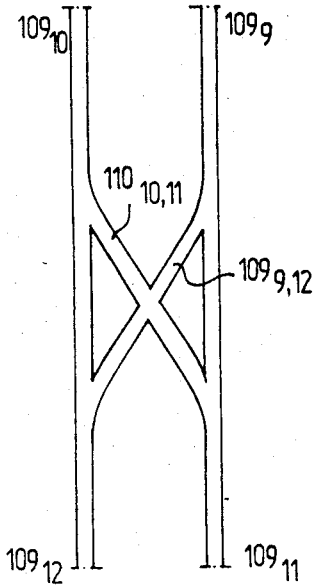
FIG. 42 is a diagram relating to a variant of the FIG. 41 embodiment.

FIG. 42 is a plan view of the spool-guiding grooves 102 shown in the FIG. 39 embodiment. Grooves $109_{11}$ and $109_9$ are in line, as are grooves $109_{12}$ and $109_{10}$. The groove $109_{10}$ is connected to the groove $109_{11}$ via a doubly curved switching groove $110_{10,11}$ and the groove $109_9$ is connected to the groove $109_{12}$ via a doubly curved switching groove $109_{9,12}$.

Switching devices may be provided to co-operate with the switching grooves.

In a variant, the spool device may be held to the plate 1 by magnetic means.

Figure 14:
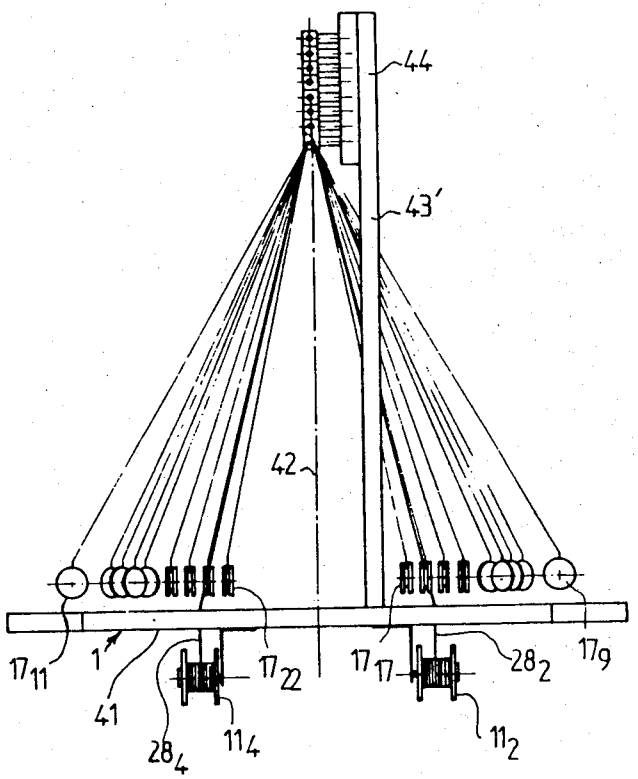
FIG. 14 is a corresponding diagrammatic side elevation view.
Figure 13:
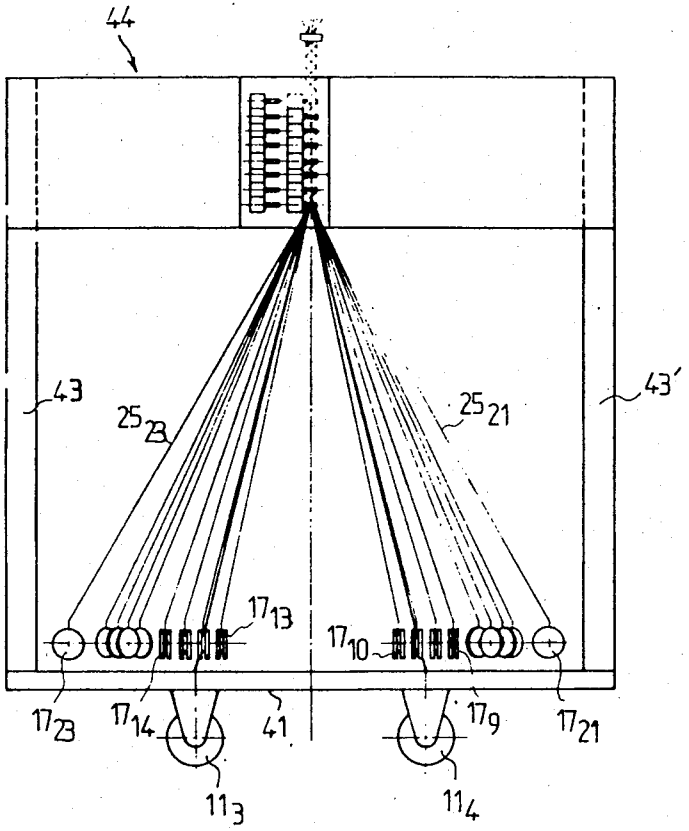
FIG. 13 is a diagrammatic front elevation of the machine.

The bottom face 41 of the plate 1 has brackets $12_1$–$12_4$ which support drums $11_1$–$11_4$ from which the cores $28_1$–$28_4$ are are unreeled to pass through holes in the plate 1 at the corners a1–a4 respectively, (see FIGS. 13 and 14).

Figure 17:
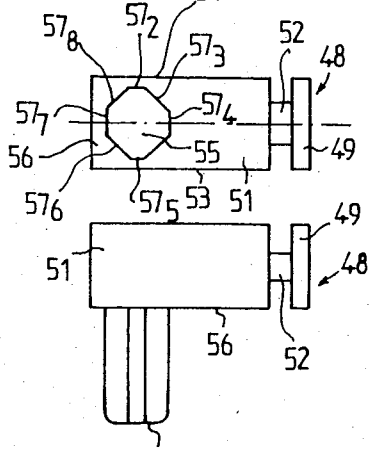
FIG. 17 is a side view of a mandrel support.
Figure 18:
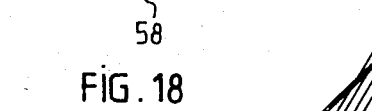
FIG. 18 is a corresponding plan view.

Risers 42, 43 are mounted on the plate 1 and support a panel 44 extending over the distance between the sides 2 and 3 of the plate 1. The panel 44 has a two-part guide device 45 (se FIGS. 15 and 16) fixed thereto and providing first and second guide paths 46 and 47. Both of these paths are intended to guide mandrel devices 48 (see FIGS. 17 and 18) each of which has a base 49 for guidance purposes and a mandrel support 51 connected thereto via a neck 52. The mandrel supports are prismatic and of square section to enable them to be stacked wit their top and bottom faces 54 and 53 respectively coming into contact.

A mandrel 55 projects away from a face 56 of each mandrel support. In the embodiment shown, each mandrel is of octagonal cross section and thus has eight faces $57_1$ to $57_8$, together with a front end face 58.

Means are provided, as indicated by a broad arrow 1 (FIG. 15) for moving the bottom mandrel of the row 47 to the bottom position of the row 46, which position is aligned with the position of the next-to-bottom mandrel suppport in the row 47. This movement follows an L-shaped path indicated by arrow 59. Means are also provided, as indicated by a broad arrow 3, for moving the top mandrel support from the row 46 to the top of the row 47 once the top of the row 47 is left vacant by the mandrel supports in said row moving down one position as indicated by a broad arrow 2.

Figure 16:
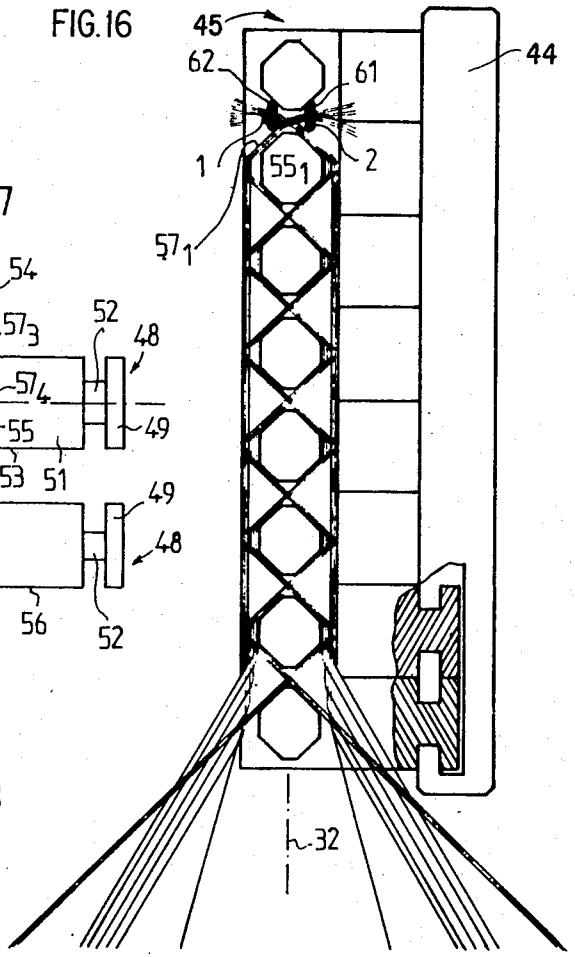
FIG. 16 is a partially cut-away corresponding side view.

In order to manufacture a frame element, threads $25_1$–$25_{24}$ are drawn by hand from the spools $17_1$–$17_{24}$ while in their initial positions (FIG. 1) and at the same time the four cores $28_1$–$28_4$ are also drawn. The threads and the cores coming from one side of the plane 32, e.g. from the left hand side as shown in FIG. 16 are clamped and held fast in a clamping member 61 situated to the right of the said plane, and the last portion of their path brings them into contact with the face $57_1$ of the mandrel $55_1$. Likewise, the threads 25 from the right hand side of the plane 32 together with the cores $28_2$ and $28_4$ drawn off their drums are clamped and held fast in a clamping device 62 on the left of the plane 32 and immediately adjacent to the face $57_3$ of the mandrel $55_1$. A sort of tent-shaped cone is thus established beneath the mandrel $55_1$ by the ends of the twenty-four threads $25_1$–$25_{24}$ together with a second, smaller tent constituted by the four cores $28_1$–$28_4$. This "tent" configuration is shown in FIG. 16 at the start of manufacturing a length other than the first length, which first length is manufactured when the mandrel $55_1$ is at the bottom of the row 46 and opposite to the bottom mandrel support of the row 47.

The threads 25 are relatively flexible in their "tent" while the cores 28 are relatively rigid. Thus the above-described movements of the spools $17_1$–$17_{24}$ provide oblique lengths of covering or winding thread.

Figure 19:
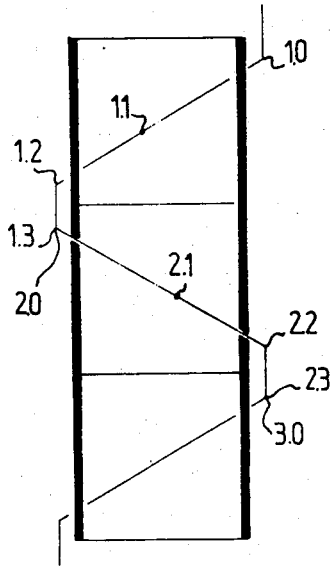
FIG. 19 is a diagrammatic elevation view for explaining how a winding is formed.
Figure 20:
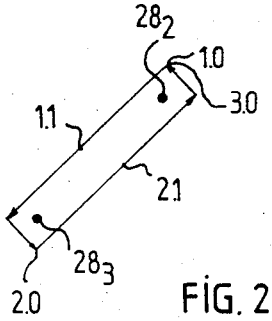
FIG. 20 is a corresponding plan view.

In the initial condition, i.e. at "Time 0", the end length of the thread $25_1$ may be represented by the point 1.0 in FIGS. 19 and 20. As the spool device or spool $17_1$ moves to the position occupied at "Time 1", it establishes a length of thread running from point 1.0 to point 1.1. The configuration of the thread $25_1$ relative to the cores 28 is not modified so long as the spool $17_1$ remains stationary on the plate 1, i.e. until "Time 6". In the next step after "Time 6", the spool $17_1$ is moved again: the longitudinal movement of the spool corresponds to the thread following a path from point 1.1 to a point 1.2, and its transverse movement corresponds to the thread following a path from the point 1.2 to a point 1.3. The thread does not pause at the point 1.2, but is run from point 1.1 to point 1.3 in a single step. The first period is now over.

During the second period, the thread $25_1$ takes up a similar position around the cores $28_3$ and $28_2$ from a point 2.0 (the same as the point 1.3) to a point 2.3 via points 2.1 and 2.3. As before, the thread covers the portion 2.1 to 2.2 to 2.3 (which becomes a starting point 3.0 for the next period) during the second half only of the second period. The point 3.0 is the same as the point 1.0, but further down the cores.

It can thus be seen that during each period, the thread moves round one side or the other of the plane defined by the cores $28_2$ and $28_3$ and that two successive periods serve to wind one oblique turn of the thread around the cores. Such a turn may be considered as being a single turn of a flat helical winding around the longitudinal cores $28_2$ and $28_3$.

At the same time as the thread $25_1$ is being wound round the cores $28_2$ and $28_3$, the thread $25_2$ is also being wound round the same cores, but during each period the threads $25_1$ and $25_2$ are located on opposite sides thereof.

Similarly, the threads $25_3$ and $25_4$ are simultaneously wound around the cores $28_2$ and $28_3$ (i.e. around the cores a2 and a3) but they slope in the opposite directions to the threads $25_1$ and $25_2$.

The threads $25_1$ and $25_2$ are initially further apart than are the threads $25_3$ and $25_4$, and then the threads $25_3$ and $25_4$ are further apart than are the threads $25_1$ and $25_2$, and so on in alternation, such that the thread $25_1$ alternately crosses the thread $25_3$ on the outside and then on the inside, and then on the outside, etc.

Turns of the threads $25_5$ to $25_{24}$ are wound around corresponding pairs of the cores a1 to a4 in the same manner, except that instead of winding helical turns around the diagonally opposite pair of cores a2 and a3 as described above, the threads $25_5$ to $25_8$ wound around the other diagonally opposite pair of cores a1 and a4, the threads $25_9$ to $25_{13}$ are wound around the pair of cores a2 and a4, the threads $25_{13}$ to $25_{16}$ are wound around the pair of cores a1 and a3, the threads $25_{17}$ to $25_{20}$ are wound around the pair of cores a1 and a2, and the threads $25_{21}$ to $25_{24}$ are wound around the pair of cores a3 and a4.

Consequently, during two successive periods, each of the threads is wound, by virtue of the displacements of the spool from which it is unwound, round one helical turn about a pair of cores. The cores may be diagonally opposite or otherwise, and the threads cross one another alternating each half turn between crossing on the inside and crossing on the outside. The result is a three-dimensional braid or strand.

The particular disposition of the spools on the plate, and the movements performed by the spools are selected as a function of the required characteristics of the resulting structural member, depending on the forces it is intended to withstand.

Figure 15:
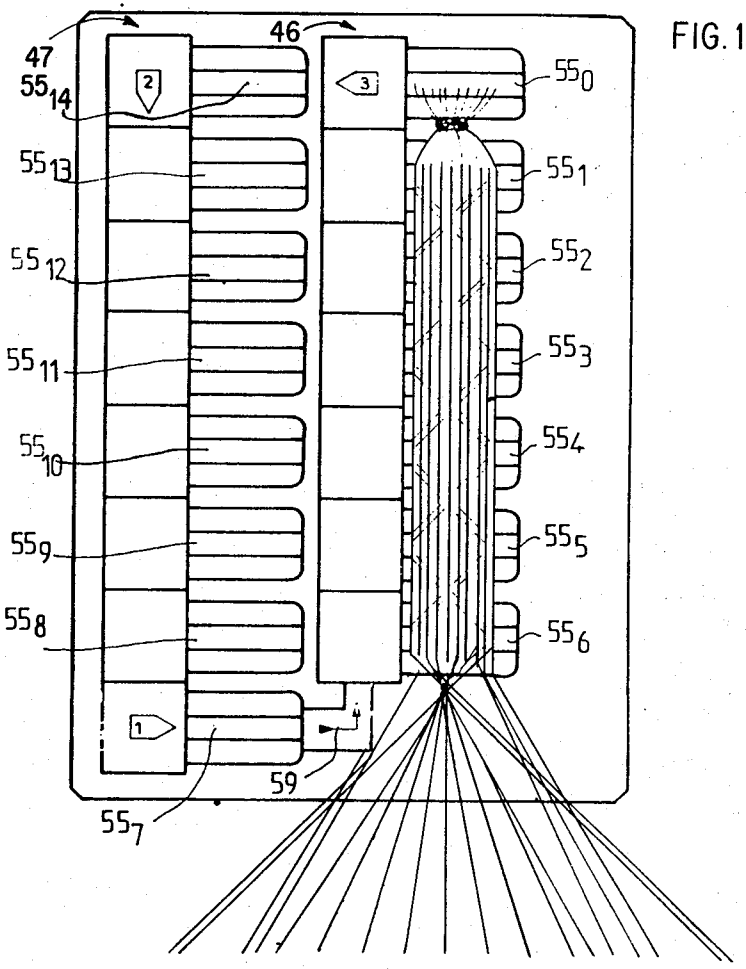
FIG. 15 is front view to a larger scale of panel carrying mandrel supports.

When the strand length corresponding to one mandrel is completed, e.g. corresponding to the mandrel $55_6$ in FIG. 15, i.e. after the spools have performed two successive periods of displacements, another mandrel, in this case the mandrel $55_7$, is taken from the bottom of the row 47 and is engaged horizontaly into the "tents" of threads and cores running from the mandrel $55_6$. Once engaged in the "tents", the new mandrel is raised one step to take up the position previously occupied by the mandrel $55_6$. The stack of mandrels in the row 46 is thus moved up by one step, except for the top mandrel in the row 46, $55_0$, which is moved horizontally to occupy the top position in the other row 47, which position was previously occupied by the mandrel $55_{14}$. The top position is freed by virtue of the mandrels in the row 47 all moving down one step once the bottom mandrel $55_7$ has been moved over to the row 46.

Once the new mandrel $55_7$ has taken the place of the old mandrel $55_6$, the next length of structural member is fabricated by moving the spools 17 over the plate 1 as explained above.

Manufacture then continues by repeating the cycle as often as may be necessary.

Figure 21:
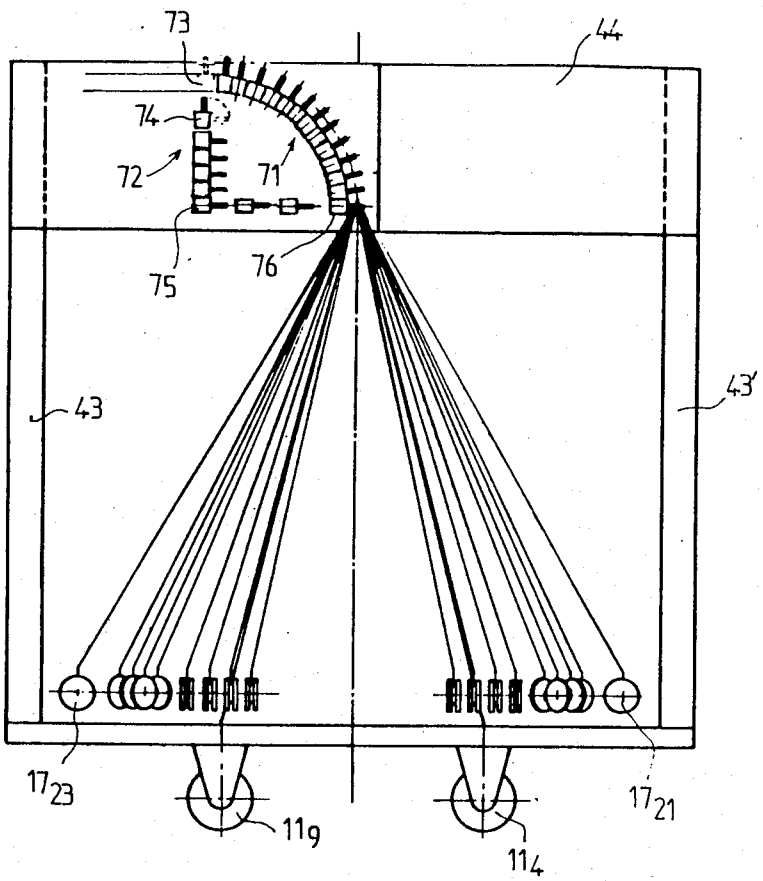
FIG. 21 is a view similar to FIG. 13, but showing another embodiment of the device carrying the mandrel supports.

In one particular embodiment, the mandrel drive device is so shaped as to directly obtain a frame member which is curved as shown in FIG. 21, rather than being rectilinear as shown in FIGS. 13 and 14. The mandrel circuit then includes a curved portion 71, e.g. following an arc of a circle, and a vertical return portion 72. When the mandrel shown at 73 arrives at the end of the path 71, it takes up the top position of the return path 72, as shown at 74. Thereafter is turned through 90° so that once it arrives at the bottom of the return path, as shown at 75, it may be moved horizontally to be inserted into the bottom of the curved path at 76.

The resulting frame member has substantially the same shape as the curved path 71. This technique may be used to directly manufacture a tennis racket frame.

Figure 22:
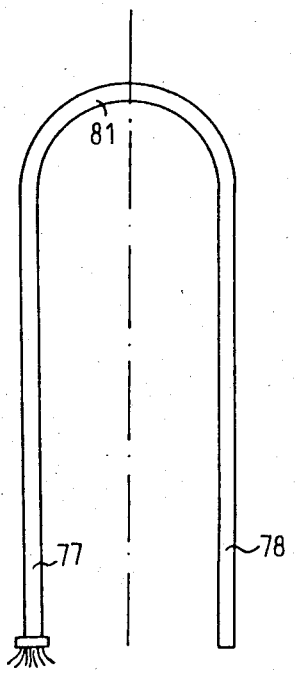
FIG. 22 is a diagrammatic view of a frame member in accordance with the invention.

As shown in FIG. 22, it is also possible to obtain a frame member having two parallel straight arms 77 and 78 which are joined by a curved portion 81.

Once the desired length of frame member has been manufactured, the frame member is separated from the machine by cutting its constitutent threads and cores.

Figures 23, 24, 25, 26, 28, 29, 30, 31:
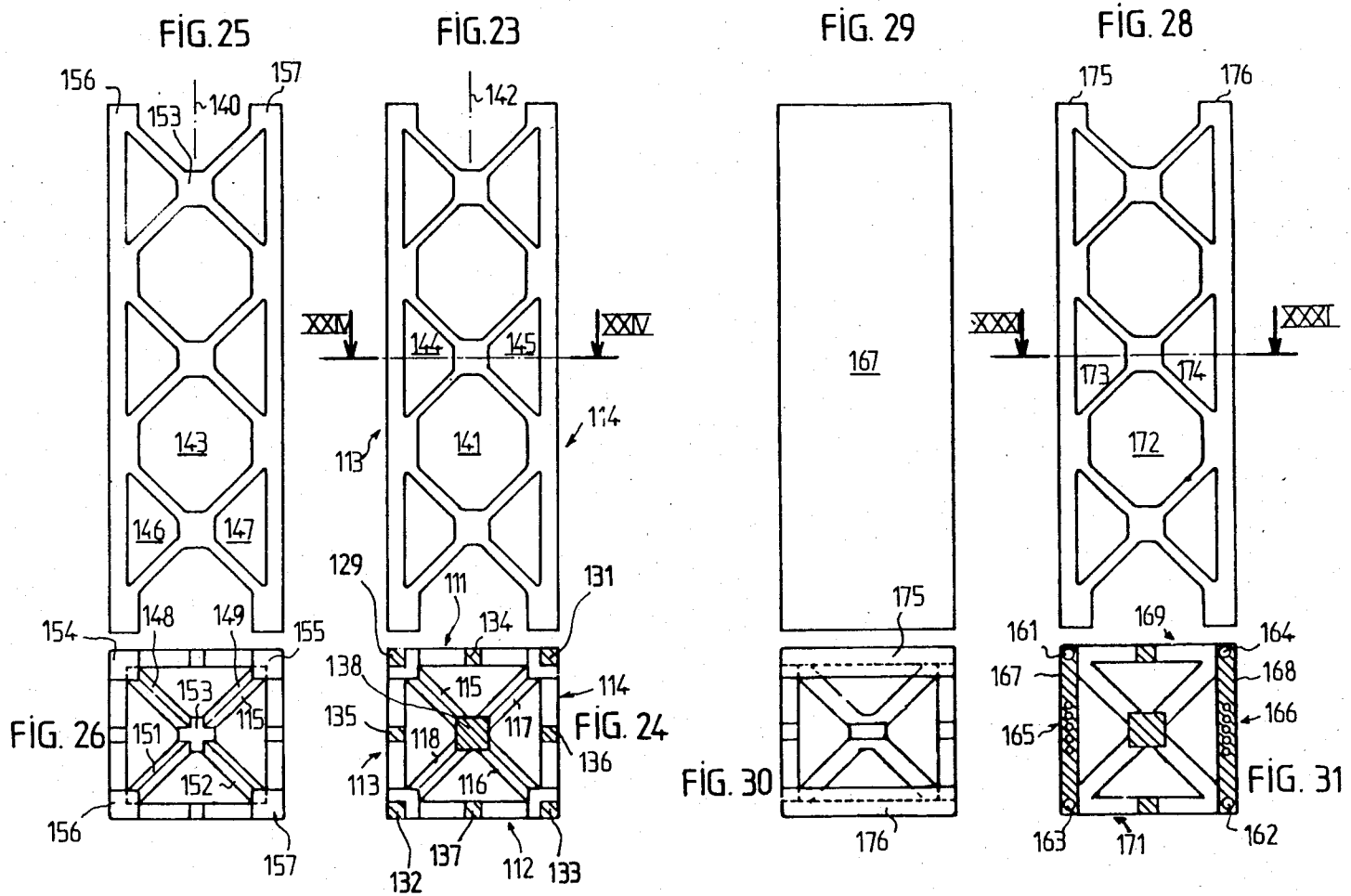
FIG. 23 is an elevation of a frame member in accordance with the invention.
FIG. 24 is a section on a line XXIV—XXIV of FIG. 23.
FIG. 25 is a similar view to FIG. 23, but at 90° thereto.
FIG. 26 is a corresponding plan view seen from above.
FIG. 28 is a similar view to FIG. 23, but showing another form of frame member.
FIG. 29 is a similar view to FIG. 28, but at 90° thereto.
FIG. 30 is a plan view seen from above and corresponding to FIG. 29.
FIG. 31 is a section on a line XXXI—XXXI of FIG. 28.

FIGS. 23 upwards relate to structural members manufactured by a machine in accordance with the invention.

FIGS. 23 to 27 show a beam having four parallel thread-like cores included in the shaded corner portions of the section shown in FIG. 24. These cores are the same as the cores a1 to a4 or $28_1$ to $28_4$ described above, and the threads are helically wound about the cores in the above-described manner.

The beam is of square cross section having four longitudinal faces 111, 112, 113 and 114 each of which includes openings. The beam includes diagonal windings 115, 116, 117 and 118, helical face windings 119, 121, and 122, 123 between the cores $28_3$, $28_4$ and $28_1$, $28_2$ respectively, and helical side windings 125, 126, and 127, 128 between the cores $28_1$, $28_3$ and $28_2$, $28_4$ respectively (see FIG. 27).

The zones where the threads cross are shaded in FIG. 24 and are referenced 129, 131, 132, 133, 134, 135, 136 and 137. The central zone 138 is where the diagonal windings cross.

Each of the front faces has octagonal openings 141 left by the mandrels 55, which openings are symmetrical about the mid plane 142 between the parallel faces 113 and 114. Similarly, the side faces have octagonal openings 143 which are symmetrical about the mid plane 140 perpendicular to the mid plane 142. All of these faces include openings on either side of their respective planes of symmetry, 144, 145 and 146, 147 respectively.

These openings are useful for intetconnecting a frame member in accordance with the invention to other components of a structure.

At each end of the structure member, there are inclined branches 148, 149; 151, 152 which converge on a small, cross-shaped platform 153. Each end of the structure member has rectangular section appendices 154, 155, 156, 157 disposed in line with its cores.

Reference is now made to FIGS. 28 to 31 relating to another shape of braided beam.

In this beam, the structure member still has four thread-like cores disposed along the corners of a square section prism, said cores being referenced 161 to 164. During manufacture, these cores are surrounded by threads in similar manner to that described above. In addition, the structure member has two groups of parallel cores, with five cores in each group. The groups are referenced 165 and 166. The threads are also wound around these groups which do not get in the way of the winding process because of the openings in the said windings.

The completed structural member then includes two solid parallel walls 167 and 168 and two walls 169 and 171 which are perpendicular thereto and have openings. The openings in the walls 169 and 171 are octagonal in shape as can be seen for the opening 172, or are substantially trapezoidal in shape as shown at 173 and at 174. Each end of the element has two plane platforms 175 and 176 of rectangular section.

The embodiment shown in FIGS. 32 to 35 is a ladder-shaped structural member. Its cores are constituted by two pairs of adjacent thread-shaped elements 181, 182 and 183, 184. The structural member has parallel risers 185 and 186 with rungs 187 extending therebetween and with sloping reinforcing struts 188 and 189 between each rung and the adjacent risers. The side faces 191 and 192 do not have any openings.

FIG. 36 is a similar view to FIG. 33 but shows how each riser may be made from three parallel thread-like cores respectively 193, 194, 195 and 196, 197, 198. This figure shows in diagrammatic form how flat windings 190 and 203 run diagonally from the cores 193 to 198 and 195 to 196 in addition to flat windings 202 running between corresponding cores in each riser. This given rise to a step-shaped rung.

FIGS. 37 and 38 relate to a specific shape of ladder that can be manufactured on the lines shown in FIGS. 33 to 35. The structural member is then directly useable as a ladder having parallel risers 211 and 212 with rungs 213 in between to enable a man to climb the ladder. Each rung is supported by two struts 214 and 215 bearing against respective ones of the risers 211 and 212. The top of the ladder has curved portions 216 and 217 including a rising portion 218 running on from the corresponding riser, a substantially perpendicular portion 219 and a downwardly directed end portion 221, which is substantially parallel to the corresponding riser 211.

The top portion of the ladder may be obtained in the same manufacturing operation as the rest of the ladder, i.e. the risers and the rungs, by making use of a drawing device and mandrel drive like that shown in FIG. 22. Such a ladder is intended for use by firemen.

I claim:

1. A method of manufacturing structural members having high strength relative to the forces to which they are to be subjected; the members comprising parallel cores and helical windings around the cores, comprising the steps of:

forming the members by winding threads from spools;

moving the thread supply means in directions transverse to directions in which the parallel cores extend;

making at least a portion of a turn initially, during winding, then making at least a portion of a turn in a different direction;

releasing, by traction, lengths of thread suitable for fabricating one step of the frame member, the direction of release defining a traction direction;

moving the spools transversely to the traction direction along go-and-return paths corresponding to the desired shape of the windings to be made around the cores; and releasing another length of thread suitable for fabricating the next step once one step of the frame member has been made.

2. A method of manufacturing structural members having a high strength relative to the forces to which they are to be subjected, the members comprising longitudinally-extending parallel cores with helical windings interposed between said cores; said members being formed by winding threads taken from spools from which lengths of thread are drawn suitable for making a single step of a structural member, causing the spools to follow go-and-return paths transversely relative to the traction direction which is defined by the direction of the cores, with said paths corresponding to the shapes of the windings to be made around the cores, and drawing further lengths of thread from the spools once one step of the structural member has been made, in order to make another step.

3. A machine for manufacturing structural members having a high strength relative to the forces to which they are to be subjected, the members comprising parallel cores which are longitudinally extending in a traction direction, having helical windings interposed between said cores; said windings formed by winding threads taken from spools; the machine comprising a plate bearing spools of thread and bearing spools of cores, means for drawing the threads and the cores from the spools away from said plate, and means for displacing the spools over the plate transversely to the traction direction, towards and away from the traction axis.

4. A machine according to claim 3, further comprising a first driving means for driving a spool over the plate along a path which corresponds to forming a rectilinear strand of a winding pressed against a core, and a second driving means for displacing said spool in a direction transverse to said first displacement to form a rectilinear strand transverse to the first strand and pressed against said core.

5. A machine according to claim 4, wherein said second driving means drives the spool in a direction perpendicular to the direction corresponding to the direction of said first driving means.

6. A machine according to claim 4, wherein the spools are distributed in pairs of spools, with the drive means for a pair of spools conferring equipollent movements thereto.

7. A machine according to claim 3, further comprising a collar for clamping the threads taken from the spools, means for displacing the collar away from the plate after making one turn of a braid, and a mandrel fixed to the collar and having a periphery which corresponds to openings to be left through the structural member.

8. A machine according to claim 7, in which the mandrels are disposed side-by-side in a curvilinear configuration.

9. A machine for manufacturing structural members comprising longitudinal cores and threads braided around said cores, the machine comprising:

a succession of mandrels;

a plate located at a distance from said succession and supporting first rotary spools at fixed locations on which cores are wound, and second rotary spools on which threads are wound;

drawing means in mechanical communication with the spools for drawing the cores and the threads from said spools by exerting traction from one of said mandrels;

displacing means in communication with the second spools for displacing the second spools of thread in succession and independently from one another along the plate in order to supply said mandrel with the threads resulting from said traction and in correspondence with the configuration of said mandrel in order to constitute one turn of braided threads with said threads; and advancing means in communication with the mandrels through one step in order to supply the next mandrel from said thread spools in the same manner as during the preceding phase.

10. A machine for manufacturing a structural member having longitudinal cores and a braid of threads covering said cores, said machine comprising:

spools of braiding thread;

a support plate for said spools;

rotary drums carried by the same support plate and bearing the cores to be covered;

fastening means for fastening the ends of the threads and of the cores in a fastening zone which is distant from said support plate;

first displacing means in communication with the spools for displacing said spools of thread over said support plate independently from one another and causing their distance from said fastening zone to vary, said displacements shaping the ends of the threads close to said zone into a turn by winding around the ends of the cores in order to constitute said braid; and second displacing means in communication with the fastening zone for displacing said zone from said support plate by one braid step after constituting said turn.

11. A machine according to claim 10, comprising a mandrel which defines said fastening zone and serves to reserve a braid step.

12. A machine according to claim 10, comprising a multiplicity of mandrels and means for bringing each of said mandrels in succession into the fastening zone.

13. A machine according to claim 10, wherein the spools of thread are connected to jacks suitable for moving them towards and away from the projection of the fastening zone onto the plane of the spool support.

14. A machine according to claim 13, wherein the spools are disposed in parallel pairs of spools, with the spools of a pair being offset in distance relative to the support plate and laterally relative to each other.

15. A machine according to claim 14, wherein the spool support plate is substantially square in shape and some of the jacks are suitable for displacing spools diagonally, while the other jacks are suitable for displacing spools perpendicularly to the sides of the square.

16. A machine according to claim 13, wherein the moving parts of the jacks are releasably connected to the spools.

17. A machine according to claim 13, wherein said pairs of spools are themselves disposed in corresponding pairs in which the two pairs of spools are opposite each other relative to the center of the support plate, with the jacks acting on the spools of one pair during one braiding step being suitable for acting on the spools of the opposite pair during another step.

18. A machine according to claim 10, in which the spool support plate includes grooves for guiding movement of the spools.

19. A machine according to claim 9, including a first vertical column of horizontally disposed mandrels, and means for successively bringing the various mandrels of the column in operation by replacing a mandrel by the mandrel immediately below it in the column.

20. A machine according to claim 19, including means for passing a mandrel from said first column to a second, adjacent column in which the mandrel is not in operation.

21. A method of winding a thread around a predetermined prismatic contour; in particular for making a prismatic structural member which is braided from spools of thread disposed on a spool support plate, the method comprising cyclically repeating the following steps:

drawing cores away from said support plate towards a zone which is distant therefrom; said cores being drawn along generator lines of said prismatic contour, and also drawing threads from spools disposed on said support plate towards said distant zone;

taking said spools having corresponding threads drawn taut therefrom and displacing said spools over said support plate in figures which correspond to the contour to be followed by each of said threads around said cores, thereby producing one turn of said braid; and moving the braid turn away from said support plate through a distance which corresponds to the length of said turn.

22. A method according to claim 21, wherein the spools are first moved through one-half of said figures over the support plate, and after all the spools have been moved through one-half of the figure, spool displacement is restarted to complete the figure of each spool.

23. A machine for braiding a braided structural member having longitudinal reinforcing cores, the machine including a multiplicity of spools of threads to be wound around said reinforcing cores, said spools being carried by a spool support plate, the machine including the improvement of a spool-moving device adapted to carry each spool of thread over the support around the contour of a geometrical figure which is geometrically similar to the projection on said support of the contour to be followed by said thread around said cores.

24. A machine according to claim 23, wherein the spools are disposed in pairs of spools, with the spools of each pair being driven with equipollent motions.

25. A machine according to claim 23, wherein each spool follows a closed loop path, with a first half of said loop being followed in a first step and with the second half of said loop being followed in a second step.

26. A machine according to claim 23, wherein the threads are drawn by means of a fastening device which is at a distance from the spool support plate and towards which the threads drawn from the spools converge.

27. A machine according to claim 26, wherein a mandrel is disposed in the vicinity of said fastening device, and wherein the taut threads are applied against the faces of the mandrel.

28. A machine according to claim 27, comprising a plurality of mandrels disposed in a row of parallel mandrels extending along the drawing direction, with a thread-covered mandrel being replaced by an uncovered mandrel.

* * * * *